US005992658A

United States Patent [19]

Berger

[11] Patent Number: 5,992,658

[45] Date of Patent: Nov. 30, 1999

[54] SEALED BOTTLE CLOSURE WITH OPENING FOR STRAW

[76] Inventor: Joel Paul Berger, 42-08 Bell Blvd., Bayside, N.Y. 11361

[21] Appl. No.: 08/869,686

[22] Filed: Jun. 5, 1997

[51] Int. Cl.[6] ..... B65D 41/50; B65D 41/62

[52] U.S. Cl. ..... 215/232; 215/253; 215/388; 220/709; 220/258

[58] Field of Search ..... 215/232, 253, 215/324, 327, 388, 389, 387, 229, 251, 258, 349, 341; 220/229, 254, 265, 266, 309.1, 310.1, 359.1, 359.2, 705, 709, 711, 712, 713, 256, 257, 258

[56] References Cited

U.S. PATENT DOCUMENTS

| | | | |
|---|---|---|---|
| 2,724,536 | 11/1955 | Pugh, Sr. | 215/388 X |
| 3,171,580 | 3/1965 | Davis et al. | 215/388 X |
| 3,220,587 | 11/1965 | Griffin et al. . | |
| 3,343,699 | 9/1967 | Nicko . | |
| 3,392,859 | 7/1968 | Fischer . | |
| 3,568,870 | 3/1971 | Elston | 215/388 |
| 3,938,686 | 2/1976 | Milligan et al. . | |
| 4,247,016 | 1/1981 | Shaw | 220/709 X |
| 4,948,009 | 8/1990 | Sawatani . | |
| 5,025,947 | 6/1991 | Leone . | |
| 5,111,946 | 5/1992 | Glanz . | |
| 5,201,459 | 4/1993 | Bettle, Jr. et al. . | |
| 5,372,268 | 12/1994 | Han | 215/232 |
| 5,425,471 | 6/1995 | Wendt . | |
| 5,704,501 | 1/1998 | Valyi | 215/232 |

*Primary Examiner*—Allan N. Shoap
*Assistant Examiner*—Niki M. Eloshway
*Attorney, Agent, or Firm*—Ostrolenk, Faber, Gerb, Soffen, LLP

[57] ABSTRACT

A closure for a bottle opening comprising a cap for the bottle opening, the cap adapted to be securely but removably fastened to the bottle opening, a seal underlying the cap and being sealed to the rim of the bottle opening and sealing the bottle opening to the cap, the seal having a rupturable portion for receiving a straw, and further wherein the bottle cap is removable with contents of the bottle being sealed to the environment by the seal which remains on the bottle rim when the bottle cap is removed, the seal being selectively releasable from the bottle rim, the user having the option of removing the seal from the bottle rim or inserting a straw through the rupturable portion to dispense the contents of the bottle.

6 Claims, 2 Drawing Sheets

SEALED BOTTLE CLOSURE WITH OPENING FOR STRAW

BACKGROUND OF THE INVENTION

The present invention relates to a sealed closure, and in particular, to a sealed closure for a bottle. Even more particularly, the present invention relates to a removable sealed closure for a bottle which includes a closure top and an opening in the seal thereof for a straw, i.e., a drinking straw. The bottle remains sealed even after the bottle top is removed, but allows a straw to be inserted at the appropriate time as desired by the user.

Various patents are known for providing seals on bottles and also for dispensing liquids from the bottles. U.S. Pat. No. 3,230,587 to Griffin et al. discloses a bottle with a self-contained drinking straw. Once the bottle top is removed, the contents of the bottle are exposed to the environment through the self-contained telescoping straw in the bottle.

U.S. Pat. No, 3,392,895 to Fischer discloses a perforable self-sealing container closure. The closure includes a cap element which is perforated by score lines to guide and locate tube penetration for removal of the contents of the bottle without removal of the cap from the bottle. A seal element is provided which is perforable or penetrable so that the tube can break the seal. A sleeve-like region of the seal provides a new seal joint against the tube. The device of this reference does not allow the user the option of removing the contents both through a tube or by drinking the contents directly from the bottle container.

U.S. Pat. No. 3,938,686 discloses a paint container having a multi-laminate seal including pre-stressed films designed to enable a slit to be made in the seal surface permitting access to the paint. The device of this reference relates to wide rimmed containers such as paint containers and not to narrow mouth bottles or containers.

U.S. Pat. No. 3,343,699 to Nicko discloses a combination cap and capping plug for spouts, bottles or the like. This device includes a sheet metal cap having a central opening affording access to a central diaphragm located below the cap. A rubber plug is mounted against the underside of the top wall of the cap and has an outwardly projecting flange adapted to form a seal between the cap the bottle. The plug has a downwardly projecting stopper portion on which the central diaphragm is disposed. A tapping pipe is adapted to penetrate the diaphragm. The plug also has an upwardly projecting annular flange extending around the diaphragm and received in the opening in the cap. A layer of adhesive is disposed between the upper side of the plug and the top wall of the cap. A stopper portion of the plug is adapted to tightly receive the tapping pipe which is disposed through the opening in the cap and the rupturable diaphragm. This reference is similar to the Fischer reference in that the tapping pipe is inserted through a hole in the metal cap, which is not removed.

Other patents of interest include U.S. Pat. No. 4,948,009 to Sawatani for a straw-insertable lid for a paper cup; U.S. Pat. No. 5,024,947 to Leone for a single dose beverage cup and rectangular cross-section straw assembly; U.S. Pat. No. 5,111,946 to Glanz for a safety bottle with a cover having a cut through its top to create an integral one-way valve; U.S. Pat. No. 5,201,459 to Bettle, Jr. et al. for a gable-top beverage container with a dispensing means; and U.S. Pat. No. 5,425,471 to Wendt for a production piece with partible port and production method therefor.

None of the references provide a simple seal for a bottle cap which seal remains in place after the bottle cap is removed and which affords the user two options in dispensing the contents of the bottle after the cap is removed, namely, penetrating the seal at a prescribed location to allow insertion of a straw or the removal of the seal to allow drinking of the contents of the bottle directly.

SUMMARY OF THE INVENTION

It is an object of the present invention to provide a seal for a bottle which remains in place after the user has removed the bottle cap.

It is yet still a further object of the present invention to provide a seal for a bottle which allows the user the option of removing the seal after the cap has been removed or of penetrating the seal at a prescribed location for the insertion of a straw.

It is yet still a further object of the present invention to provide a seal for a bottle which remains sealed after the cap is removed until the seal is removed or selectively penetrated by a straw.

Yet still a further object of the present invention is to provide a simple and convenient bottle seal to manufacture and to use.

The above and other objects of the present invention are achieved by a closure for a bottle opening comprising a cap for the bottle opening, the cap adapted to be securely but removably fastened to the bottle opening, a seal underlying the cap and being sealed to the rim of the bottle opening and sealing the bottle opening to the cap, the seal having a rupturable portion for receiving a straw, and further wherein the bottle cap is removable with contents of the bottle being sealed to the environment by the seal which remains on the bottle rim when the bottle cap is removed, the seal being selectively releasable from the bottle rim, the user having the option of removing the seal from the bottle rim or inserting a straw through the rupturable portion to dispense the contents of the bottle.

Other objects, features and advantages of the present invention will become apparent from the detailed description which follows:

BRIEF DESCRIPTION OF THE DRAWINGS

The invention will now be described in greater detail in the following detailed description with reference to the drawings in which.

DETAILED DESCRIPTION OF EMBODIMENTS OF THE INVENTION

Figure 1:
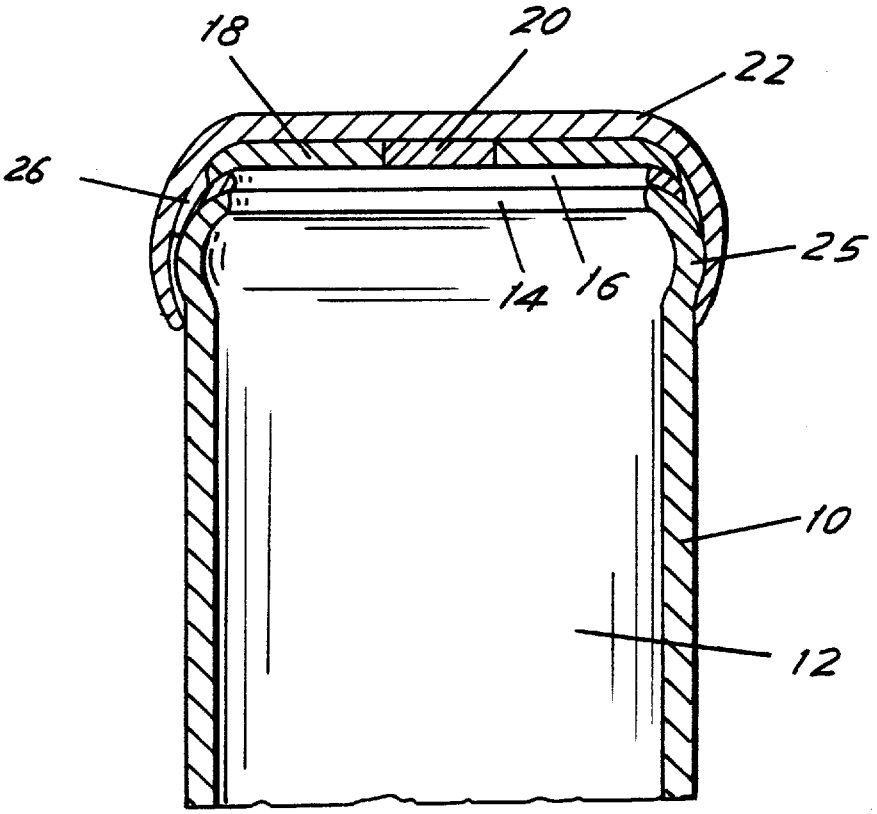
FIG. 1 is a cross-sectional view of a bottle opening showing the bottle cap and seal according to the present invention.

With reference now to the drawings, the cap and seal for a bottle according to the present invention are shown. FIG. 1 shows a cross-section through the opening of a bottle 10. The bottle has an opening 12 having a circular lip 14 defining the opening. The circular lip 14 has an adhesive substance 16 disposed around the rim. The adhesive substance 16 is disposed between the rim 14 of the opening of the bottle 10 and a sealing membrane 18 which overlies the entire opening 12 so as to releasably hold the seal to the bottle rim 14. The sealing membrane 18 includes a preferably central portion 20 which is rupturable. For example, the portion 20 may have one or more rupturable partial perforations therein which are in sealing relationship (i.e., not ruptured) until the partial perforations are ruptured by the insertion of, for example, a drinking straw. Sealing membrane 18 may be made of any suitable sealing material, such as a plastic or rubber. It may be transparent, translucent or opaque. Atop the membrane 18 is a bottle cap 22 which may comprise, for example, a metal or plastic bottle cap suitably attached to the bottle 10, for example, by crimping around a head 25 adjacent the bottle opening. The bottle cap 22 is in sealing relationship with the sealing membrane 18, particularly in the annular region overlying the bottle rim 14.

Figure 2:
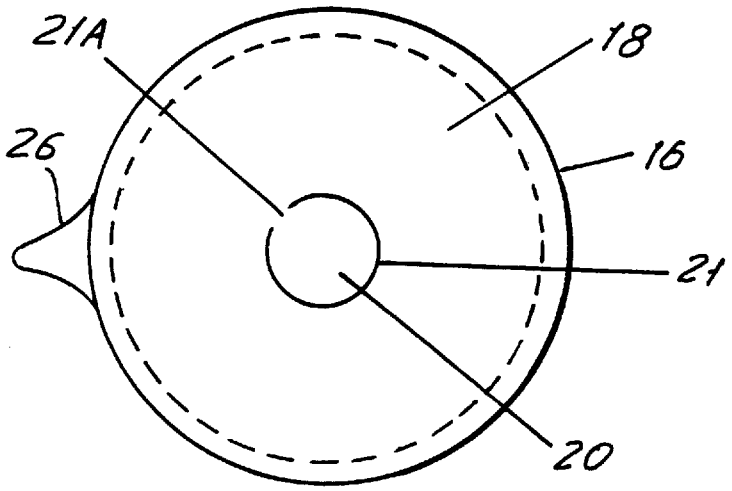
FIG. 2 is a top view of the seal of the present invention with the bottle cap removed.

FIG. 2 is a top view of the sealing membrane 18 showing the central perforable region 20 and the adhesive material 16 therebelow which releasably glues the sealing membrane 18 with the rim 14 of the bottle 10. Also shown is a tab 26, which allows the user to grasp the sealing membrane 18 and optionally remove the seal 18 from the bottle top by releasing adhesive layer 16, preferably from the bottle rim. Preferably, the rupturable portion defined by a partial perforation line 21 having an arcuate scoreline and a non-perforated portion 21A to prevent the center of the rupturable portion from separating from the seal 18 and falling into the bottle.

Figure 3:
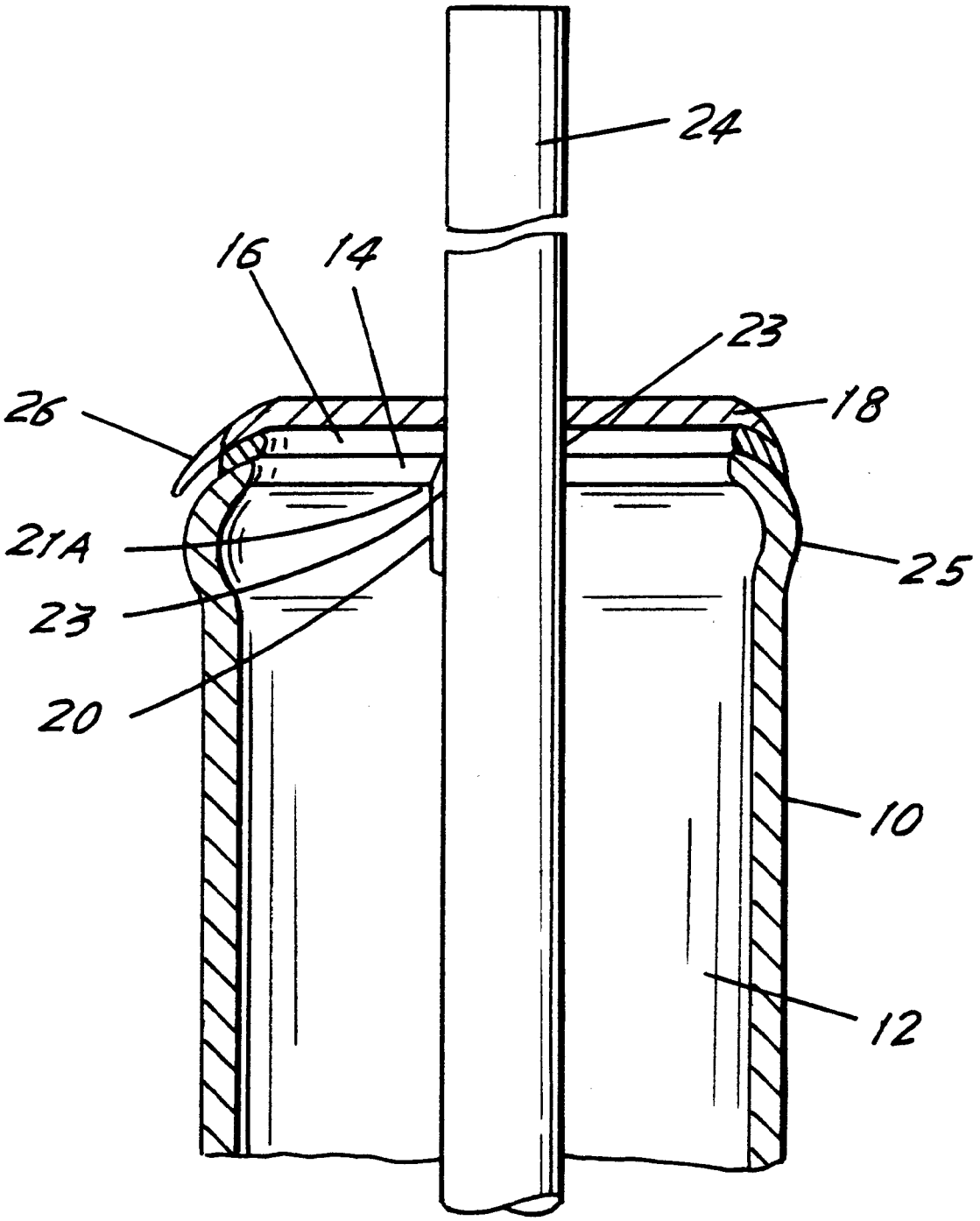
FIG. 3 is a cross-sectional view of a bottle opening showing the seal according to the present invention with the bottle cap removed and a straw inserted through the rupturable portion of the seal.

FIG. 3 is a cross-section like FIG. 1 showing the bottle cap 22 removed and showing a straw 24 inserted therein through the perforable portion 20 of the sealing membrane 18. The rupturable portion 20 is shown extending vertically downward into the bottle hanging from its pivot point defined by non-perforated region 21A. Preferably, a seal is formed between the straw and the perimeter 23 of the opening defined by the rupturable portion after rupturing by the straw.

The invention provides advantages over prior art designs in that once the bottle cap 22 is removed, the contents of the bottle 10 remain sealed until such time as the sealing membrane 18 is removed or the perforable portion 20 is perforated by a straw 24. The user thus has the option of drinking the contents of the bottle directly or via the straw. The seal thus helps in preventing, e.g., carbonation from escaping until the seal is broken.

In order to assist in removal of the sealing membrane 18, the tab 26 may be provided, as shown most clearly in FIG. 2.

Although the present invention has been described in relation to particular embodiments thereof, many other variations and modifications and other uses will become apparent to those skilled in the art. The present invention should therefore be limited not by the specific disclosure herein, but only by the appended claims.

What is claimed is:

1. A bottle and closure for an opening of the bottle, the bottle opening having a rim and the closure comprising:

a cap for the bottle opening the cap adapted to be securely but removably fastened to the bottle opening;

a sealing membrane formed as a single thin sheet of material having a substantially uniform thickness, said sealing membrane underlying the cap and being sealed to the rim of the bottle opening and sealing the bottle opening to the cap, the sealing membrane having a rupturable portion for receiving a straw and being secured to the rim of the bottle opening by a releasable adhesive; and further wherein the bottle cap is removable with contents of the bottle being sealed to the environment by the sealing membrane which remains on the bottle rim when the bottle cap is removed, the sealing membrane being selectively releasable from the bottle rim, the user having the option of removing the sealing membrane from the bottle rim or inserting a straw through the rupturable portion to dispense the contents of the bottle and further wherein the rupturable portion comprises a portion of the sealing membrane which is defined by at least one partial perforation line in the sealing membrane, said partial perforation line can be ruptured by the insertion of a straw and said partial perforation line comprising a substantially arcuate and nearly circular scoreline and a region which is not scored to permit the rupturable portion to remain attached to the sealing membrane when the rupturable portion is ruptured.

2. The bottle and closure for said bottle opening of claim 1, wherein the cap comprises a metal cap crimped around a bead on the bottle disposed circumferentially around the bottle opening.

3. The bottle and closure for said bottle opening of claim 1, further comprising a manually graspable tab for facilitating removal of the seal.

4. The bottle and closure for said bottle opening of claim 1, wherein the rupturable portion of the seal is approximately centered on the seal.

5. The bottle and closure for said bottle opening of claim 1, further comprising a drinking straw for insertion through the rupturable portion of the seal.

6. The bottle and closure for said bottle opening of claim 1, wherein a seal is formed between the seal and the straw when the rupturable portion is ruptured.

* * * * *